US012789966B1

(12) United States Patent
Baer et al.

(10) Patent No.: US 12,789,966 B1
(45) Date of Patent: Nov. 10, 2026

(54) SYSTEMS AND METHODS FOR CONTROLLING SHIFT AND THROTTLE OF AN ELECTRIC MARINE DRIVE

(71) Applicant: Brunswick Corporation, Mettawa, IL (US)

(72) Inventors: Mitchell J. Baer, Fond du Lac, WI (US); Lukas G. Neveau, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 18/738,487

(22) Filed: Jun. 10, 2024

(51) Int. Cl.
*B63H 21/21* (2006.01)
*B63H 23/08* (2006.01)

(52) U.S. Cl.
CPC ..... *B63H 21/213* (2013.01); *B63H 23/08* (2013.01); *B63H 2021/216* (2013.01)

(58) Field of Classification Search
CPC . B63H 21/213; B63H 23/08; B63H 2021/216
USPC ..... 701/21
See application file for complete search history.

(56) References Cited

U.S. PATENT DOCUMENTS 6,406,342 B1 6/2002 Walczak
9,764,813 B1 9/2017 Zarembka
9,828,080 B1 * 11/2017 Belter ..... B63H 21/22
10,155,578 B1 * 12/2018 Osthelder ..... G05D 1/0016
10,246,173 B1 4/2019 Ingerbritson
2013/0030663 A1 * 1/2013 Chan ..... B60W 10/06 701/54
2014/0229083 A1 * 8/2014 Leehaug ..... F16H 61/08 701/60
2018/0134362 A1 * 5/2018 Despineux ..... B63H 21/213
2021/0354803 A1 * 11/2021 Christensen ..... B60L 58/21
2023/0242229 A1 * 8/2023 Yageta ..... B63H 21/213 440/6
2024/0092469 A1 * 3/2024 Miyagi ..... B63H 21/21
2025/0042526 A1 * 2/2025 Ikegaya ..... B63H 21/17

FOREIGN PATENT DOCUMENTS

EP 4369561 A2 * 5/2024 ..... B60L 3/04

* cited by examiner

*Primary Examiner* — Kenneth M Dunne
*Assistant Examiner* — Brian K Palmarchuk
(74) *Attorney, Agent, or Firm* — Andrus Intellectual Property Law, LLP

(57) ABSTRACT

A marine propulsion system includes an electric marine drive comprising an electric motor powerhead configured to rotate a propulsor, a shift user interface configured to receive user input to select between at least a forward mode wherein the electric marine drive generates a forward thrust, a reverse mode wherein the electric marine drive generates a backward thrust, and a neutral mode wherein the electric marine drive does not output any thrust, a throttle user interface configured to receive user input to command a throttle magnitude, wherein the throttle user interface is separate from the shift user interface, and a controller configured to detect that the throttle magnitude at the throttle user interface exceeds a threshold throttle input while the neutral mode is selected at the shift user interface, and engage a throttle lockout mode to prevent the marine drive from generating any thrust output upon receiving a shift command at the shift user interface to shift to the forward mode or the reverse mode until an unlatch condition is met.

20 Claims, 5 Drawing Sheets

SYSTEMS AND METHODS FOR CONTROLLING SHIFT AND THROTTLE OF AN ELECTRIC MARINE DRIVE

FIELD

The present disclosure relates to marine propulsion systems, and more specifically to controlling shift and throttle of an electric marine drive.

BACKGROUND

U.S. Pat. No. 6,406,342 discloses a control handle for a tiller of an outboard motor is provided with a rotatable handle grip portion that includes an end surface which supports a plurality of push buttons that the operator of a marine vessel can depress to actuate certain control mechanisms and devices associated with the outboard motor. These push buttons include trim up and trim down along with gear selector push buttons in a preferred embodiment of the present invention.

U.S. Pat. No. 9,764,813 discloses a tiller is for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 10,246,173 discloses a tiller is for an outboard motor and has a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

The above patents are hereby incorporated by reference herein in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the disclosure, a marine propulsion system includes an electric marine drive comprising an electric motor powerhead configured to rotate a propulsor, a shift user interface configured to receive user input to select between at least a forward mode wherein the electric marine drive generates a forward thrust, a reverse mode wherein the electric marine drive generates a backward thrust, and a neutral mode wherein the electric marine drive does not output any thrust, a throttle user interface configured to receive user input to command a throttle magnitude, wherein the throttle user interface is separate from the shift user interface, and a controller configured to detect that the throttle magnitude at the throttle user input device exceeds a threshold throttle input while the neutral mode is selected at the shift user interface, and engage a throttle lockout mode to prevent the marine drive from generating any thrust output upon receiving a shift command at the shift user interface to shift to the forward mode or the reverse mode until an unlatch condition is met.

In one embodiment, the controller is further configured to generate an alert when the shift command is received at the shift user interface to shift to the forward mode or the reverse mode when the throttle lockout mode is engaged.

In another embodiment, the threshold throttle input includes that the throttle magnitude exceeds a threshold magnitude.

In another embodiment, the threshold throttle input includes the threshold magnitude being maintained for at least a threshold time.

In another embodiment, the threshold time is greater than or equal to three seconds.

In another embodiment, the threshold time is greater than or equal to seven seconds.

In another embodiment, the threshold magnitude is a threshold demand percent, a threshold RPM, a threshold torque, or a threshold motor current.

In another embodiment, the threshold magnitude is a value between 5% and 25% of a maximum output for the marine drive.

In another embodiment, the unlatch condition includes the throttle magnitude being less than an unlatch magnitude.

In another embodiment, the unlatch magnitude is less than a threshold magnitude associated with the threshold throttle input.

In another embodiment, the unlatch magnitude is greater than or equal to a threshold magnitude associated with the threshold throttle input, and wherein the unlatch condition further includes receiving a selection of the neutral mode at the shift user interface device after receiving a selection of the forward mode or the reverse mode at the shift user interface.

In another embodiment, the unlatch condition includes receiving a selection of the neutral mode at the shift user interface after receiving a selection of the forward mode or the reverse mode at the shift user interface.

In another embodiment, the shift user interface is a shift lever and the throttle user interface is a rotatable handle on a tiller arm.

In another aspect of the disclosure, a method of controlling a marine propulsion system is provided. The marine propulsion system includes an electric marine drive comprising an electric motor powerhead configured to rotate a propulsor, a throttle user interface configured to receive user input to command a throttle magnitude, and a shift user interface configured to receive user input to select between at least a forward mode wherein the electric marine drive generates a forward thrust, a reverse mode wherein the electric marine drive generates a backward thrust, and a neutral mode wherein the electric marine drive does not output any thrust, wherein the shift user interface is separate from the throttle user interface. The method includes receiving a user input at the shift user interface selecting the neutral mode, detecting that the throttle magnitude at the throttle user interface exceeds a threshold throttle input while the neutral mode is selected at the shift user interface, and engaging a throttle lockout mode preventing the marine drive from generating any thrust output upon receiving a shift command at the shift user interface to shift to the forward mode or the reverse mode until an unlatch condition is met.

In one embodiment, the method further includes generating an alert when the shift command is received at the shift user interface to shift to the forward mode or the reverse mode when the throttle lockout mode is engaged.

In another embodiment, the threshold throttle input includes that the throttle magnitude exceeds a threshold magnitude.

In another embodiment, the threshold throttle input includes the threshold magnitude being maintained for at least a threshold time.

In another embodiment, the threshold magnitude is a threshold demand percent, a threshold RPM, a threshold torque, or a threshold motor current.

In another embodiment, the unlatch condition includes the throttle magnitude being less than an unlatch magnitude.

In another embodiment, the unlatch condition includes receiving a selection of the neutral mode at the shift user interface after receiving a selection of the forward mode or the reverse mode at the shift user interface.

BRIEF DESCRIPTION OF THE DRAWINGS

Examples of electric marine propulsion systems and assemblies therefor are described with reference to the following Figures.

DETAILED DESCRIPTION

Figure 1:
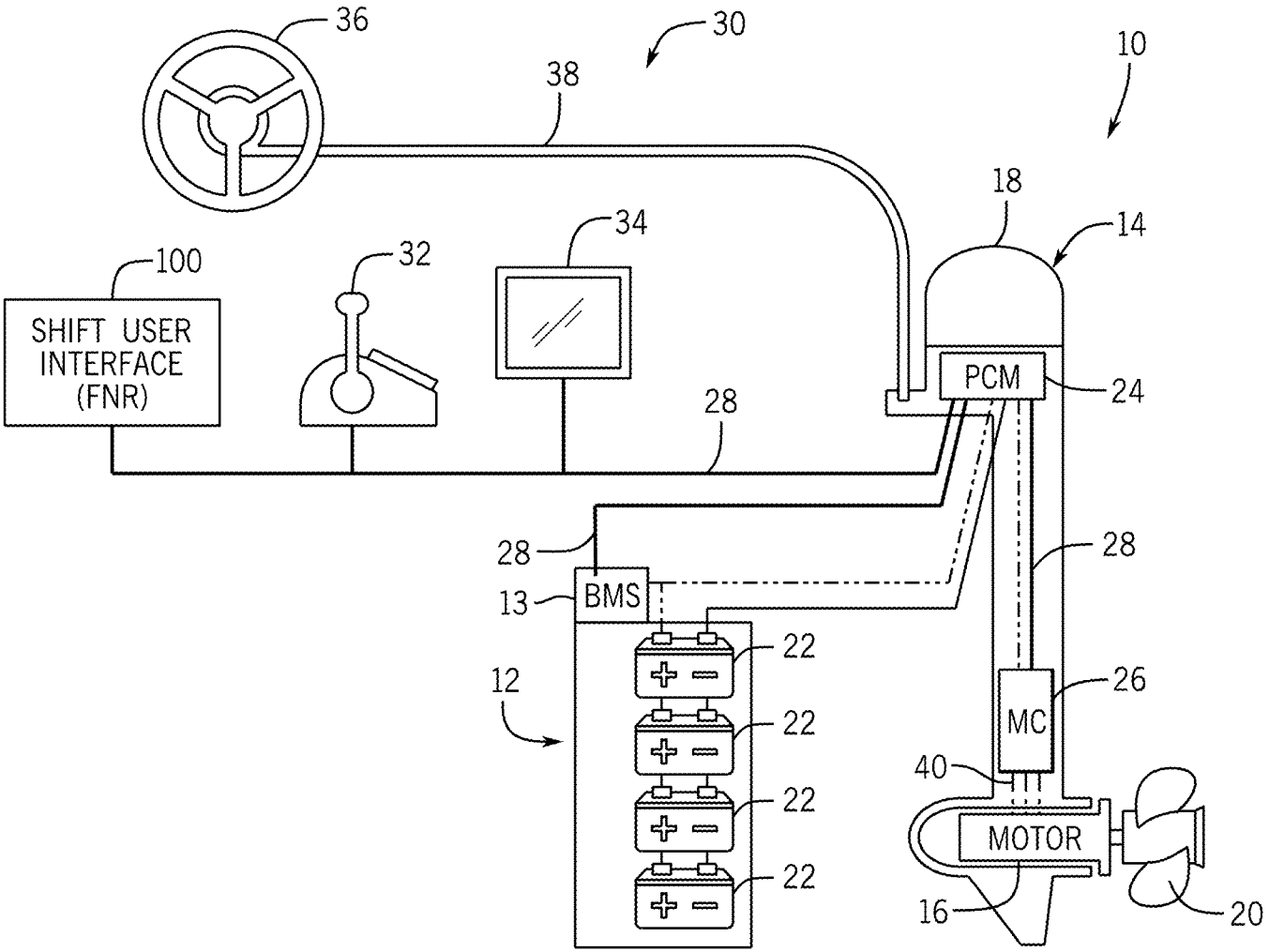
FIG. 1 is a schematic showing an exemplary electric marine propulsion system according to the present disclosure.

In the present description, certain terms have been used for brevity, clarity and understanding. No unnecessary limitations are to be inferred therefrom beyond the requirement of the prior art because such terms are used for descriptive purposes only and are intended to be broadly construed.

In a marine propulsion system with two independent user interface devices for throttle and shift, the operator can use the shift user interface to provide a shift input while the throttle user interface is unknowingly left at a high demand. This presents the potential for initializing a direction of travel for the propulsion system that produces an unexpected or higher-than-expected thrust. The inventors have recognized that this is particularly a problem for electric marine drive systems, where the motor is not turning when the neutral mode is engaged and there may be no audible or tactile indicator to the user that the throttle user interface is locked at a position commanding a high throttle magnitude. Marine propulsion systems with combustion marine drives that utilize separate throttle and shift inputs tend not to have this issue because the operator will hear the engine running at a high RPM in response to the throttle command and, because these products are mechanically shifted (e.g., via a transmission, clutch, or other gear system), they see high resistance to shift input when the engine speed is high.

The inventors developed the disclosed control system for electric marine propulsion systems to avoid effectuating thrust responsive to unintentional throttle commands due to a locked throttle user interface by inhibiting shifts when the throttle magnitude is left above a threshold magnitude (%), such as for a threshold period of time. This disclosure relates to a control system for an electric marine drive where the throttle and shift are commanded through user interface controls that are separate from one another and configured such that a throttle magnitude command can be provided via the throttle user interface and a shift mode is selected at a shift user interface. This invention is particularly applicable to systems where a throttle user interface can hold a given position, such as a lockable tiller handle or a lever that holds a position when the user lets go. The motor has no movement while the neutral mode is selected, and thus there is not any tactile or audible clue from the marine drive that alerts the operator to the locked, or held, throttle position. Thus, the user can inadvertently leave a high throttle magnitude command in place while the drive is shifted to neutral and then forget or inadvertently leave it in place. To avoid effectuating a thrust that is not intended by the operator, the disclosed system is configured to engage a throttle lockout mode such that when the operator selects forward or reverse, the control system does not actuate the throttle magnitude input associated with the held position of the throttle user interface, thereby causing the vessel to move at a rate that the operator may not have intended. Magnitude thresholds for determining engagement of the throttle lockout mode to inhibit shift and/or effectuating the commanded throttle magnitude may include a threshold throttle demand percent, a threshold RPM command, a threshold torque command, and/or a threshold motor current command. When inhibiting thrust output in the lockout mode, the propulsion system will generate audio and/or visual alerts to alert the operator that the throttle demand is too high and needs to be reduced before a throttle demand can be executed. By requiring that the locked throttle magnitude be maintained for a predetermined time threshold prior to engagement of the lockout mode, the control system allows "panic shifting" and otherwise toggling between shift modes at high throttle demands, such as when docking. When docking, the operator may lockout a high throttle demand, shift to neutral and drift, and then immediately input a shift command to forward or reverse to intentionally input a high throttle demand, such as opposite the direction of travel to slow the vessel down as it approaches the dock. The disclosed system is configured such that it does not prevent intentional high demand shifts, such as that just described, where the operator will be expecting/requiring full thrust during maneuvers.

FIG. 1 illustrates an embodiment of an electric marine propulsion system 10 powered by a power storage system, such as a battery pack 12. In the depicted embodiment, the electric marine propulsion system 10 includes an outboard electric marine drive 14 having an electric motor powerhead 16 housed therein, such as housed within the cowl 18 of the outboard electric marine drive 14. A person of ordinary skill in the art will understand in view of the present disclosure that the electric marine propulsion system 10 may include other types of electric marine drives, such as inboard drives, stern drives, jet drives, or the like. In still other examples, the electric marine drive may be a deployable and stowable device coupled to a hull assembly, such as for a pontoon boat. The exemplary electric marine drive 14 shown here has the noted electric motor powerhead 16 configured to propel the marine vessel by rotating a propulsor, such as a propeller 20. The electric motor powerhead 16 may be, for example, a brushless electric motor, such as a brushless DC motor. In other embodiments, the electric motor powerhead 16 may be a DC brushed motor, an AC brushless motor, a direct drive, a permanent magnet synchronous motor, an induction motor, or any other device that converts electric power to rotational motion. In certain embodiments, the electric motor powerhead 16 includes a rotor and a stator, as is well known in the relevant art.

The electric motor powerhead 16 is electrically connected to and powered by the battery pack 12. The battery pack 12 stores energy for powering the electric motor powerhead 16 and is rechargeable, such as by connection to shore power when the electric motor powerhead 16 is not in use. Various battery packs are known in the art and are suitable for powering an electric marine drive 14, such as various Lithium-ion battery pack arrangements. In the depicted example, a bank or group of batteries 22, or cell modules, is connected in series to provide a large voltage output. In one example, the battery pack 12 may be a high voltage battery pack providing 250 V DC or more, such as 450 V DC, 550 V DC, or 800 V DC. The battery pack 12 may further include a battery management system (BMS) 13 configured to monitor and/or control aspects of the battery pack 12. For example, the BMS 13 may receive inputs from one or more sensors within or on the battery pack 12. The BMS 13 is configured to determine a battery state of health and to recognize a hazardous condition based on any one or more of the interior or exterior sensor measurements. For example, the state of health may be determined based on measured temperature and/or rate of internal temperature rise, internal pressure measurements, battery orientation, G-levels endured, water exposure and/or the duration thereof, etc.

One or more hardware controllers receive inputs from a user interface system 30, such as a throttle user interface 32, a shift user interface 100, and a display 34, and communicate corresponding control commands to control the motor 16 and propulsion generated thereby. A propulsion control module (PCM) 24 communicates with a motor controller 26 of the motor 16 via communication link 28, such as a controller area network (CAN) bus. The PCM 24 also receives input from and/or communicates with one or more user interface devices in a user interface system 30 via the communication link 28, which in some embodiments may be the same communication link as utilized for communication between the controllers 13, 24, 26 or may be a separate communication link. The user interface devices in the user interface system 30 of the exemplary embodiment include a throttle user interface 32, a shift user interface 100, and a display 34. In various embodiments, the display 34 may be, for example, part of an onboard management system, such as VesselView™ by Mercury Marine of Fond du Lac, Wisconsin. The user interface system 30 may also include a steering wheel 36, which in some embodiments may also communicate with the PCM 24 to effectuate steering control over the electric marine drive 14, which is well-known and typically referred to as a steer-by-wire arrangement. In the depicted embodiment, however, the steering wheel 36 is a manual steer arrangement in which the steering wheel 36 is connected to a steering actuator that steers the electric marine drive 14 by a steering cable 38.

Figure 2:
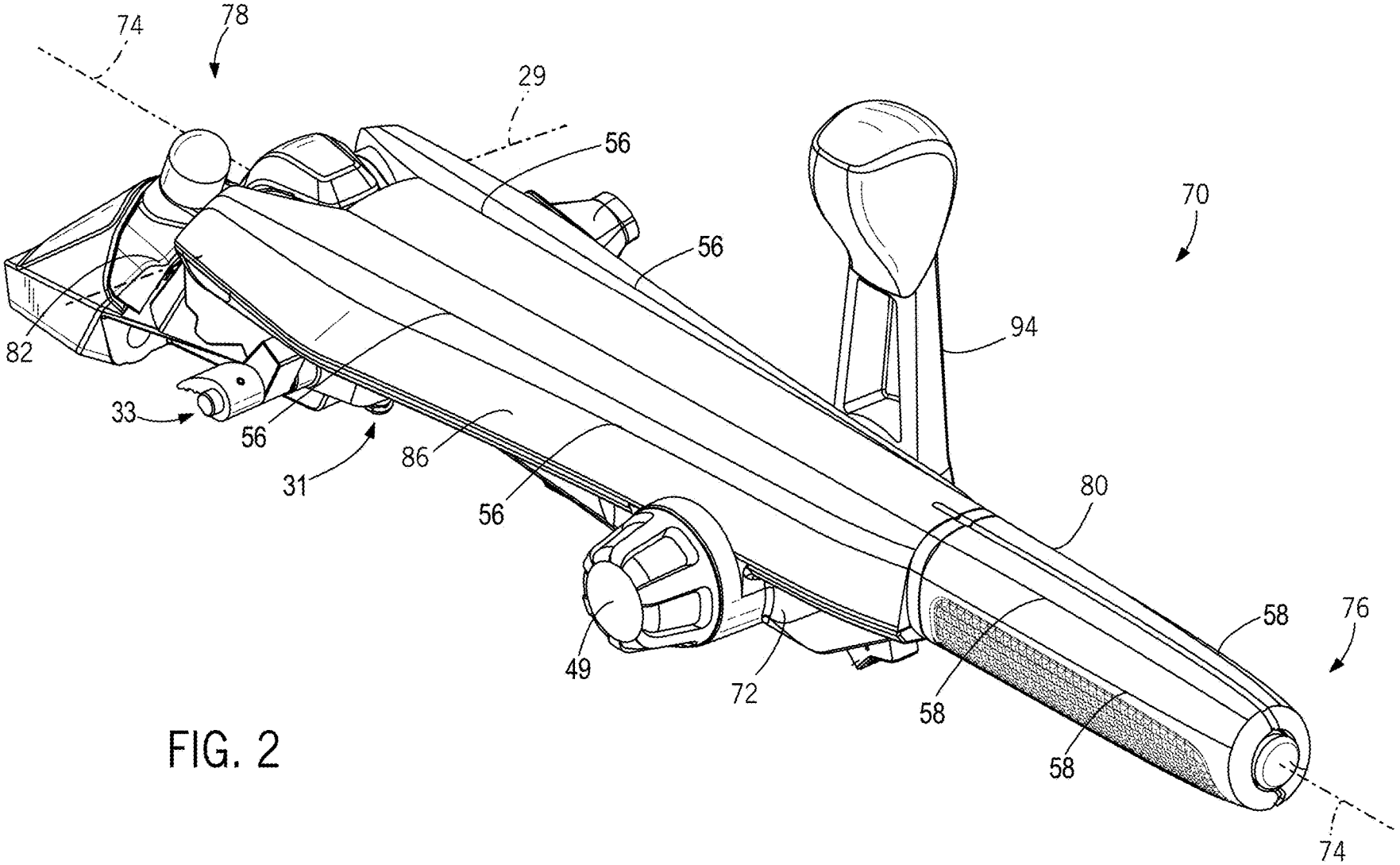
FIG. 2 is a perspective view of the tiller in a horizontal position according to one embodiment of the present disclosure.

The throttle user interface 32 may be, for example, a lever as shown in FIG. 1 or a rotatable handle on a tiller arm as shown in FIG. 2. In other embodiments, the throttle user interface 32 may be a pedal. In still other embodiments, the throttle user interface 32 may be a slider, a rocker, or a push button or set of push buttons or any user interface device that can receive an input from a user indicating a value within a range of values that could be used to provide a throttle magnitude input. The shift user interface 100 may be configured to receive user input to select a shifting mode between at least a forward mode wherein the electric marine drive generates a forward thrust, a reverse mode wherein the electric marine drive generates a backward thrust, and a neutral mode wherein the electric marine drive does not output any thrust. In some embodiments where the electric marine drive includes a transmission or gear shifting system, this shift mode selection may be associated with a shift position of the gear system. Otherwise, in a direct drive system where the rotation of the motor is translated directly to the propeller rotation, the shift mode selection may be associated with a rotation direction of the electric motor powerhead 16, where the motor is rotated in a first direction to effectuate a forward thrust and rotated in the opposite direction to effectuate a reverse thrust. The shift user interface 100 may include, for example, selectable options on the display 34 (e.g., a touch screen configured to enable a user select forward, reverse, or neutral), or may be another type user interface device in which the user can select one of the at least three modes, such as one or more buttons, keys, or switches (e.g., three buttons or switches or a three position switch) or a lever. FIG. 2 depicts one embodiment, where the shift user interface 100 is a shift lever 94 and the throttle user interface 32 is a rotatable handle 80 on a tiller arm.

The electric motor powerhead 16 may be associated with the noted motor controller 26, which is configured to control power to the electric motor powerhead 16, such as to the stator winding thereof. The motor controller 26 is configured to control the function and output of the electric motor powerhead 16, such as controlling the torque outputted by the motor 16, the rotational speed of the motor 16, and the input current, voltage, and power supplied to and/or utilized by the motor 16. In one arrangement, the motor controller 26 controls the current delivered to the stator windings via leads 40, which input electrical energy to the electric motor powerhead 16 to induce and control rotation of the rotor. Sensors may be configured to sense the power, including the current and voltage, delivered to the motor 16. The motor controller 26 is configured to provide appropriate current and/or voltage to meet the demand for controlling the motor 16. For example, a demand input may be received at the motor controller 26 from the PCM 24, such as based on an operator demand at a helm input device, such as the throttle user interface 32.

Referring to FIG. 2, the tiller 70 has a tiller chassis 72 that extends in an axial direction along a tiller axis 74. The tiller chassis 72 has a first axial end 76 and an axially opposite, second axial end 78. A rotatable throttle handle 80 is supported on the first axial end 76 and is rotatable to receipt a throttle magnitude input. An adjustable mount 82 is located at the second axial end 78, and is configured to facilitate pivoting of the tiller 70 through a range of motion including at least into and between a horizontal position wherein the tiller chassis 72 extends horizontally and a vertical position wherein the tiller chassis 72 extends vertically. The type and configuration of adjustable mount 82 can vary from what is shown, and for example can include any one or a combination of adjustable mount embodiments. An exemplary adjustable mount is disclosed in U.S. Pat. No. 9,764,813. As is conventional, the adjustable mount 82 allows for pivoting of the tiller 70 through the range of motion about a horizontal pivot axis 29. An optional adjustment bolt 31 and ratchet lever 33 are located at the adjustable mount 82 and facilitate positional and pivoting movement, as is conventional.

In one embodiment, the tiller 70 has a throttle linkage that links the rotatable throttle handle 80 to a throttle on an outboard electric motor, as is conventional. The throttle linkage includes a throttle shaft that is disposed in the interior of the tiller 70 such that the tiller chassis 72 is located vertically beneath and supports the throttle shaft (not shown) when the tiller 70 is in the horizontal position.

The rotatable throttle handle 80 provides a throttle magnitude command. A rotatable locking knob 49 is coupled to the mounting sleeve. Rotation of the locking knob 49 in one direction squeezes the mounting sleeve to lock the position of the throttle shaft and rotatable throttle handle 80 thus facilitating hands-free operation. Opposite rotation of the locking knob 49 relaxes the mounting sleeve and thus allows manual rotation of the rotatable throttle handle 80 and associated throttle shaft. Rotation of the rotatable locking knob 49 is configured to lock the throttle handle 80 in a given position, thereby maintaining a throttle magnitude command without requiring the user to continue holding the rotatable throttle handle 80. The rotatable throttle handle 80 may be configured remain locked in a given position until the rotatable locking knob 49 is rotated to unlock the rotatable throttle handle 80 position, and such locked position may be maintained regardless of changes in shift mode inputted at the shift user interface 100, 94. Thus, the operator may lose track of the fact that the throttle lock is engaged and may command a shift to the forward or reverse mode with the rotatable throttle handle 80 locked in a position commanding a high throttle magnitude.

A shift lever 94 is coupled to the tiller chassis 72. The shift lever 94 may be used regardless of whether there is a transmission or not, such as when the marine drive is a direct drive wherein the electric motor is configured to directly rotate the propulsor to rotate in a first direction to generate forward thrust and to rotate the opposite rotational direction to generate backward thrust. The shift linkage includes a shift link that is disposed in the interior of the tiller 70 such that the tiller chassis 72 is located vertically beneath and supports the shift link when the tiller 70 is in the horizontal position.

A first set of axial alignment ribs 56 axially extends along the top cover 86. A second set of axial alignment ribs 58 extends along the rotatable throttle handle 80. The first and second sets of axial alignment ribs 56, 58 are in alignment when the rotatable throttle handle 80 is located in an idle position. In contrast, the first and second sets of axial alignments ribs 56, 58 move out of alignment with each other when the rotatable throttle handle 80 is located out of the idle position shown. Advantageously, this allows the operator to see and feel the position of the throttle grip with respect to the top cover 86 and tiller chassis 72.

Figure 3:
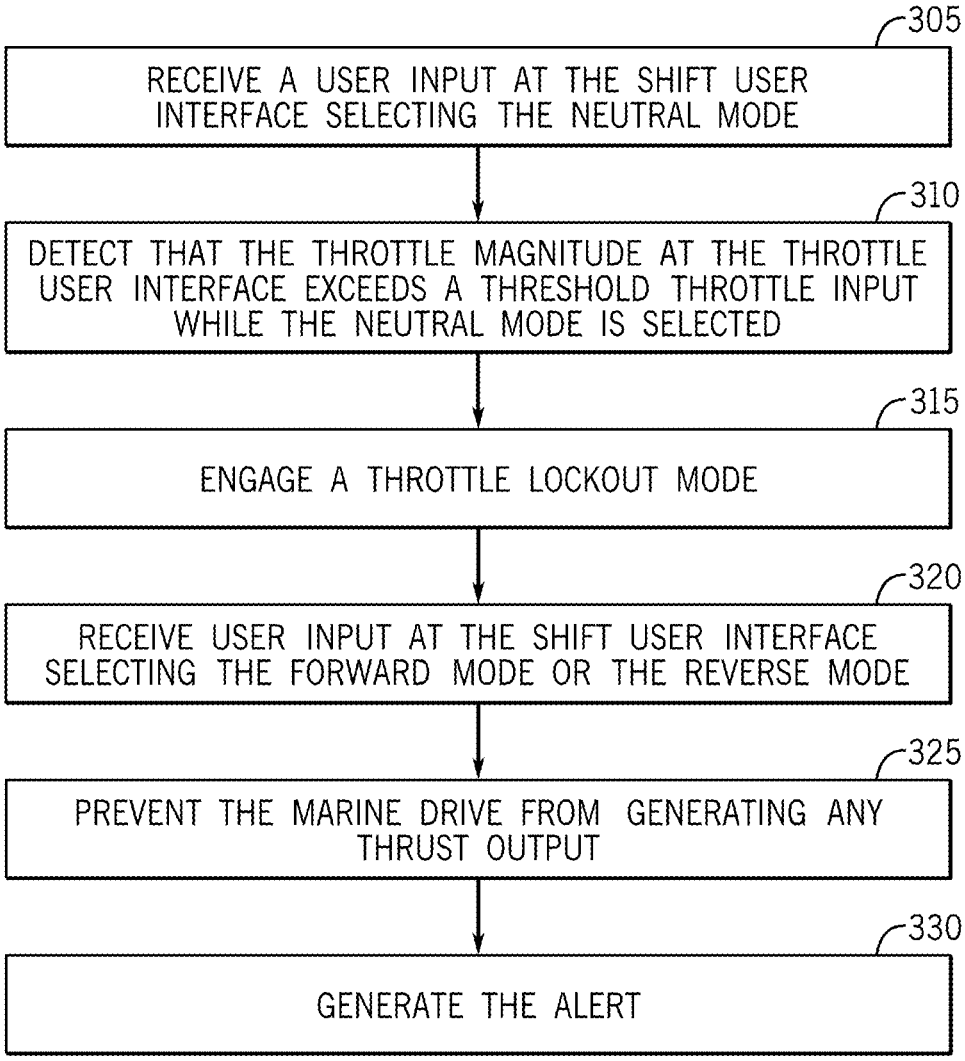
FIG. 3 are exemplary method steps for controlling an electric marine propulsion system according to one embodiment of the present disclosure.

FIG. 3 illustrates exemplary method steps for controlling a marine propulsion system. At 305, a user input is received at the shift user interface selecting the neutral mode. Embodiments of a shift user interface and separate throttle user interface shown and described with respect to FIGS. 1 and 2, but in other embodiments may include a system with shift lever and separate throttle lever or handle, shift buttons with a throttle lever or handle, or any system having a shift input device that is a separate user input mechanism from a throttle input device. The shift user interface is configured to receive user input to select between at least a forward mode wherein the electric marine drive generates a forward thrust, a reverse mode wherein the electric marine drive generates a backward thrust, and a neutral mode wherein the electric marine drive does not output any thrust. At 310, the controller detects that the throttle magnitude at the throttle user interface exceeds a threshold throttle input while the neutral mode is selected. The threshold throttle input may include a magnitude component and/or a time component, such as requiring that the throttle magnitude is at least a threshold magnitude and is maintained for at least a threshold time while the neutral mode is engaged. When the threshold throttle input condition is satisfied while the neutral mode is engaged, the controller engages a throttle lockout mode at step 315 to prevent the marine drive from generating any thrust output until an unlatch condition is met. At 320, a user input is received by the controller via the shift user interface selecting the forward mode or the reverse mode. At 325, due to the throttle lockout mode being engaged, the controller controls the marine drive to prevent any thrust output in response to the shift command at the shift user interface and the throttle command at the throttle user interface. At 330, the alert is generated via a user interface device, which may include an auditory alert (such as a beep or an alarm) and/or a visual alert (such as the illumination of a fault warning light on the tiller or on the dash at the helm). Thus, the system is configured to generate an alert in response to a shift command being received at the shift user interface to shift to the forward mode or the reverse mode while the throttle lockout mode is engaged.

Figure 4:
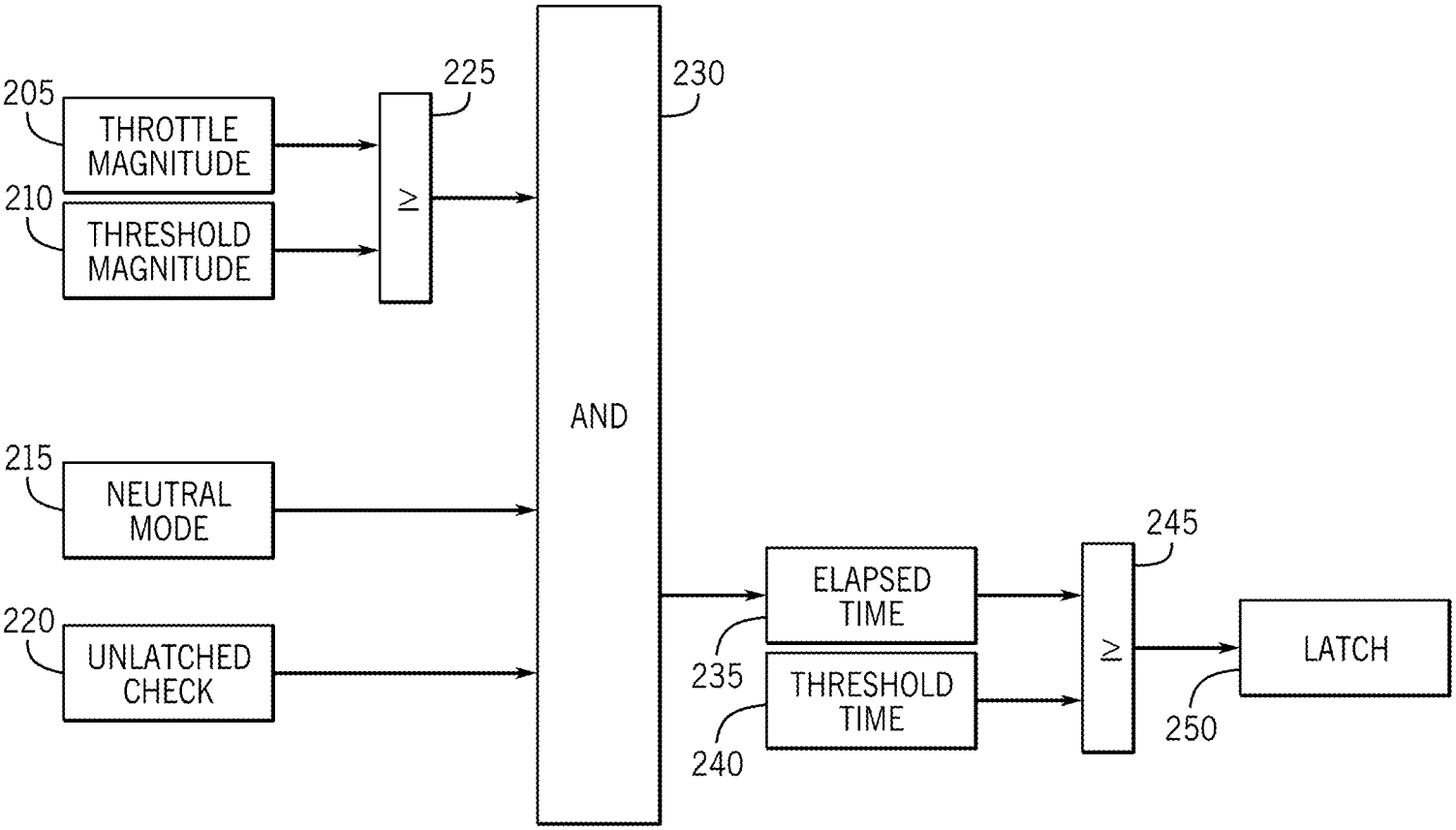
FIGS. 4-6 are exemplary control logic diagrams for controlling an electric marine propulsion system according to embodiments of the present disclosure.

FIG. 4 depicts a control logic diagram exemplifying one embodiment of control logic for engaging the throttle lockout mode. At step 225, the controller determines whether the current throttle magnitude 205 inputted at the throttle user input is greater or equal to a threshold magnitude at step 210. For example, the threshold magnitude may include a value between 5% and 25% of a maximum output for the marine drive, which may be reflected as a threshold demand percent, a threshold RPM, a threshold torque, or a threshold motor current.

At step 215, the control logic is executed to indicate whether the current shift mode is the neutral mode, such as outputting a one or a predetermined value when the shift lever position is in neutral. At step 220, a value is inputted to indicate whether or not the throttle lockout mode is engaged. If the lockout mode is already engaged, or latched, then logic is executed to determine whether an unlatch condition is met, one embodiment of which is exemplified in FIG. 5.

At step 230, the controller determines whether all initial conditions are met, including that the throttle magnitude exceeds the throttle threshold, the neutral mode is engaged, and the throttle lockout mode is not currently engaged. Logic is then executed to determine whether these conditions continue to remain true for a threshold time 240. When the elapsed time 235, such as based on the output of a timer or other counter, exceeds a threshold time 240, as determined at logic block 245, the throttle lockout mode is latched at 250 preventing the marine drive from generating any thrust output upon receiving a shift command at the shift user interface to shift to the forward mode or the reverse mode until an unlatch condition is met. The threshold time may differ based on the configurations of the marine vessel. For example, the threshold time may be greater than or equal to three seconds, greater than or equal to five seconds, greater than or equal to seven seconds, or as much as 10 seconds or 12 seconds. Up until the elapsed time exceeds the threshold time at logic block 245, the controller will respond to operator shift and throttle inputs as usual, such as engaging a forward mode. Once a shift mode other than neutral is engaged, or any of the initial conditions are not satisfied, the timer measuring the elapsed time 235 is reset and restarted at zero the next time the initial conditions are met.

The threshold time may be set to enable the propulsion system to respond to rapid high throttle demands, such as "panic shifting", in scenarios where the operator will be expecting/requiring full thrust during these maneuvers. For example, when docking, the operator may perform a maneuver where they lockout a high throttle demand while traveling in forward, shift to neutral and drift, and then immediately input a shift command to reverse to intentionally input a high reverse throttle demand to slow the vessel down as it approaches the dock. The threshold time may be set such that it does not prevent intentional high demand shifts, such as the described docking maneuver. In some implementations, the threshold time may be a calibratable value, such as calibrated on system setup, or may be a user-modifiable value that a user can set (e.g., via a user interface at the helm, at the tiller, or via a remote computer or other device in wireless communication with the controller and configured to receive and communicate the user-set time value.

Figure 5:
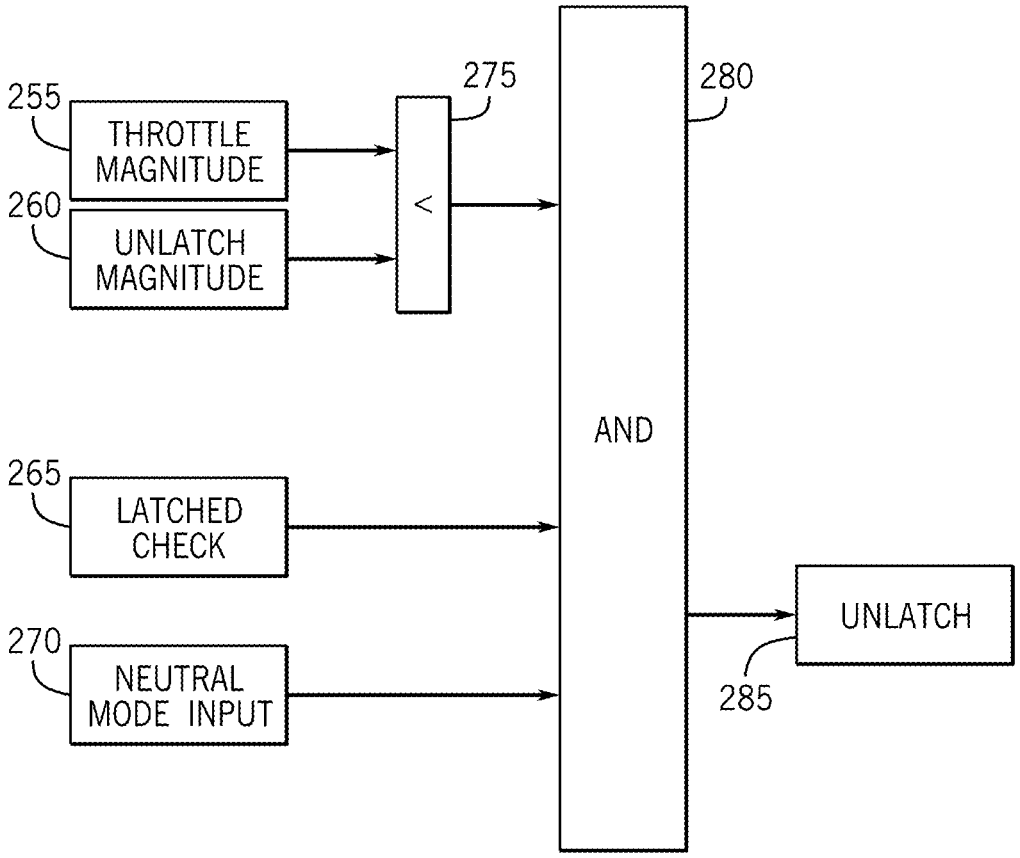

In FIG. 5, a control logic diagram is shown illustrating exemplary logic for assessing whether an unlatch condition is met to disengage the throttle lockout mode. At step 275, logic is executed to determine whether the throttle magnitude 255 is less than an unlatch magnitude 260. In various embodiments, the unlatch magnitude 260 may be less than, greater than, or equal to the threshold magnitude to engaging the throttle lockout mode. In one embodiment, the unlatch magnitude may be zero, thus requiring that the throttle demand is returned to zero to disengage the throttle lockout mode. In another embodiment, the unlatch magnitude is greater than or equal to a threshold magnitude associated with the threshold throttle input, wherein the unlatch condition further includes receiving a shift command to shift out of and back into the neutral mode—e.g., receiving a selection of the neutral mode at the shift user interface device after receiving a selection of the forward mode or the reverse mode at the shift user interface. Accordingly, the unlatching logic receives an input value indicating the gear mode. One unlatch condition may include receive of a user input 270 to select the neutral mode at the shift user interface, such as following a user input selecting the forward or reverse modes. The unlatch logic may be further based on an input value 265 indicating whether the throttle lockout mode is unlatched. For example, the input value 265 may be set equal to 0 if the throttle lockout mode is not engaged and set to 1 if the throttle lockout mode is engaged.

Logic 280 is executed to determine whether the unlatch conditions are satisfied, which in this embodiment includes that the throttle value is less than an unlatch threshold, the throttle lockout mode is currently engaged, and an input is received to select the neutral mode. If all the unlatched conditions are satisfied, then the throttle lockout mode is disengaged at step 285. Once the controller unlatches the throttle lockout mode, the conditions for assessing relatch (e.g., the logic illustrated in FIG. 4) are reassessed and the timer measuring elapsed time restarts. If no shift command occurs commanding a shift away from the neutral mode within the threshold time, such as within 7 seconds, the controller relatches the throttle lockout mode.

Figure 6:
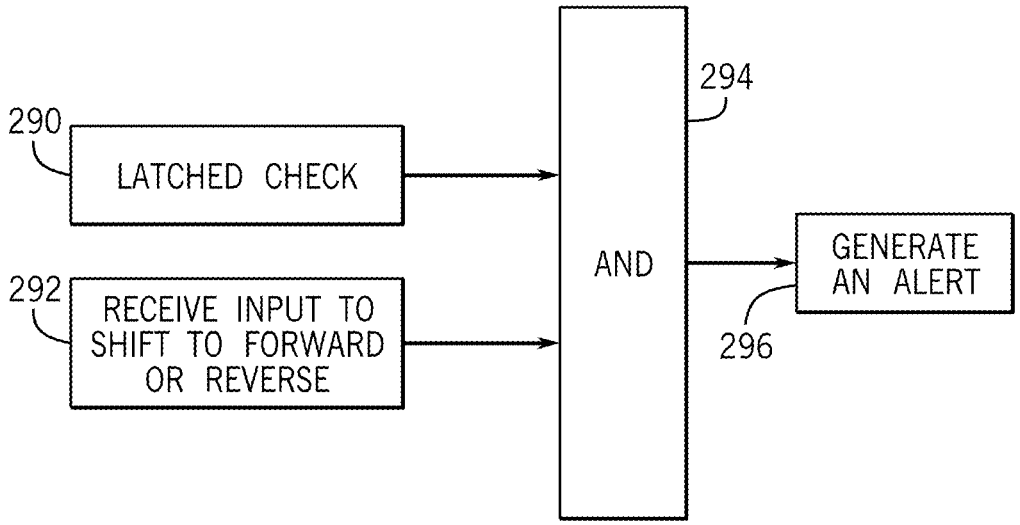

Referring now to FIG. 6, a control logic diagram is provided illustrating logic for generating an audio and/or visual alert when the throttle lockout mode is engaged. An input value 290 is provided indicating whether the throttle lockout mode is engaged, or latched. For example, the input value 290 may be one if the throttle lockout mode is latched and zero if it is unlatched. If a shift input 292 is received at the shift user input device commanding a shift to forward or reverse while the lockout mode is engaged, and thus latched, then the output of logic block 294 will be true, at which point an alert is generated at block 296. The alert may be audible, such as a chirp, beep, or siren generated by a speaker. For example the speaker may be integrated into the shift user input device, or may be integrated into the helm or the tiller system, if present. Additionally or alternatively, the alert may be visual, such as an LED fault indicator light embedded within the top cover of the tiller that indicates a fault condition related to the throttle lockout mode.

In the present description, certain terms have been used for brevity, clarity, and understanding. No unnecessary limitations are to be implied therefrom beyond the requirement of the prior art because such terms are used for descriptive purposes only and are intended to be broadly construed. The different components and assemblies described herein may be used or sold separately or in combination with other components and assemblies. Various equivalents, alternatives, and modifications are possible within the scope of the appended claims.

What is claimed is:

1. A marine propulsion system comprising:

an electric marine drive comprising an electric motor powerhead configured to rotate a propulsor;

a shift user interface configured to receive user input to select between at least a forward mode wherein the electric marine drive generates a forward thrust, a reverse mode wherein the electric marine drive generates a backward thrust, and a neutral mode wherein the electric marine drive does not output any thrust;

a throttle user interface configured to receive user input to command a throttle magnitude, wherein the throttle user interface is separate from the shift user interface;

one or more hardware controllers configured to:

detect that the throttle magnitude commanded based on a position of the throttle user interface exceeds a threshold throttle input while the neutral mode is selected at the shift user interface; and engage a throttle lockout mode to prevent the electric marine drive from generating any thrust output in response to the throttle magnitude upon receiving a shift command at the shift user interface to shift to the forward mode or the reverse mode until an unlatch condition is met.

2. The system of claim 1, wherein the at least one hardware controller is further configured to generate an alert when the shift command is received at the shift user interface to shift to the forward mode or the reverse mode when the throttle lockout mode is engaged.

3. The system of claim 1, wherein the threshold throttle input includes that the throttle magnitude exceeds a threshold magnitude.

4. The system of claim 3, wherein the threshold throttle input includes the threshold magnitude being maintained for at least a threshold time.

5. The system of claim 4, wherein the threshold time is greater than or equal to three seconds.

6. The system of claim 5, wherein the threshold time is greater than or equal to seven seconds.

7. The system of claim 3, wherein the threshold magnitude is a threshold demand percent, a threshold RPM, a threshold torque, or a threshold motor current.

8. The system of claim 3, wherein the threshold magnitude is a value between 5% and 25% of a maximum output for the electric marine drive.

9. The system of claim 1, wherein the unlatch condition includes the throttle magnitude being less than an unlatch magnitude.

10. The system of claim 9, wherein the unlatch magnitude is less than a threshold magnitude associated with the threshold throttle input.

11. The system of claim 9, wherein the unlatch magnitude is greater than or equal to a threshold magnitude associated with the threshold throttle input, and wherein the unlatch condition further includes receiving a selection of the neutral mode at a shift user interface device after receiving a selection of the forward mode or the reverse mode at the shift user interface.

12. The system of claim 1, wherein the unlatch condition includes receiving a selection of the neutral mode at the shift user interface after receiving a selection of the forward mode or the reverse mode at the shift user interface.

13. The system of claim 1, wherein the shift user interface is a shift lever and the throttle user interface is a rotatable handle on a tiller arm.

14. A method of controlling a marine propulsion system, wherein the marine propulsion system includes an electric marine drive comprising an electric motor powerhead configured to rotate a propulsor, a throttle user interface configured to receive user input to command a throttle magnitude, and a shift user interface configured to receive user input to select between at least a forward mode wherein the electric marine drive generates a forward thrust, a reverse mode wherein the electric marine drive generates a backward thrust, and a neutral mode wherein the electric marine drive does not output any thrust, wherein the shift user interface is separate from the throttle user interface, the method comprising:

receiving a user input at the shift user interface selecting the neutral mode;

detecting that the throttle magnitude commanded based on a position of the throttle user interface exceeds a threshold throttle input while the neutral mode is selected; and engaging a throttle lockout mode preventing the electric marine drive from generating any thrust output in response to the throttle magnitude upon receiving a shift command at the shift user interface to shift to the forward mode or the reverse mode until an unlatch condition is met.

15. The method of claim 14, further comprising generating an alert when the shift command is received at the shift user interface to shift to the forward mode or the reverse mode when the throttle lockout mode is engaged.

16. The method of claim 14, wherein the threshold throttle input includes that the throttle magnitude exceeds a threshold magnitude.

17. The method of claim 16, wherein the threshold throttle input includes the threshold magnitude being maintained for at least a threshold time.

18. The method of claim 16, wherein the threshold magnitude is a threshold demand percent, a threshold RPM, a threshold torque, or a threshold motor current.

19. The method of claim 14, wherein the unlatch condition includes the throttle magnitude being less than an unlatch magnitude.

20. The method of claim 14, wherein the unlatch condition includes receiving a selection of the neutral mode at the shift user interface after receiving a selection of the forward mode or the reverse mode at the shift user interface.

* * * * *